US010374294B2

(12) United States Patent
Hiramatsu

(10) Patent No.: US 10,374,294 B2
(45) Date of Patent: Aug. 6, 2019

(54) ELECTRONIC APPARATUS

(71) Applicant: KYOCERA Corporation, Kyoto (JP)

(72) Inventor: Nobuki Hiramatsu, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 15/462,986

(22) Filed: Mar. 20, 2017

(65) Prior Publication Data

US 2017/0279188 A1 Sep. 28, 2017

(30) Foreign Application Priority Data

Mar. 24, 2016 (JP) ..... 2016-060484

(51) Int. Cl.

| | |
|---|---|
| ***H01Q 1/12*** | (2006.01) |
| ***H01Q 1/27*** | (2006.01) |
| ***H01Q 1/24*** | (2006.01) |
| ***H01Q 1/44*** | (2006.01) |
| ***H01Q 3/26*** | (2006.01) |

(52) U.S. Cl.

CPC ..... *H01Q 1/273* (2013.01); *H01Q 1/245* (2013.01); *H01Q 1/44* (2013.01); *H01Q 3/26* (2013.01); *H01Q 3/2623* (2013.01)

(58) Field of Classification Search

CPC ..... H01Q 1/273; H01Q 7/00; H01Q 1/1207; H01Q 1/50; H01Q 9/26

USPC ..... 343/718, 878, 906, 908

See application file for complete search history.

(56) References Cited

U.S. PATENT DOCUMENTS 6,716,165 B1 * 4/2004 Flanders ..... A61B 5/0006 128/903
2011/0235755 A1 9/2011 Yang et al.
2012/0328134 A1 12/2012 Lewis
2013/0194141 A1 * 8/2013 Okajima ..... G02C 11/10 343/718
2014/0240474 A1 8/2014 Kondo
2015/0181388 A1 * 6/2015 Smith ..... H04W 4/026 455/426.1

FOREIGN PATENT DOCUMENTS

| | | | |
|---|---|---|---|
| CN | 102866506 | A | 1/2013 |
| JP | H11-353444 | A | 12/1999 |
| JP | 2013-513275 | A | 4/2013 |

(Continued)

OTHER PUBLICATIONS

The extended European search report issued by the European Patent Office dated Aug. 1, 2017, which corresponds to European Patent Application No. 17162570.0-1927 and is related to U.S. Appl. No. 15/462,986.

*Primary Examiner* — Dameon E Levi
*Assistant Examiner* — Collin Dawkins
(74) *Attorney, Agent, or Firm* — Studebaker & Brackett PC

(57) ABSTRACT

An electronic apparatus capable of reducing SAR and, simultaneously, suppressing degradation of antenna efficiency is provided. To that end, an electronic apparatus includes a first temple to be positioned on one side of the user's head when the electronic apparatus is worn on the user's head, a second temple to be positioned on the other side of the user's head when the electronic apparatus is worn on the user's head, an first antenna formed in the first temple, an second antenna formed in the second temple, and a transceiver circuit for supplying power to the first antenna and the second antenna.

3 Claims, 4 Drawing Sheets

(56) References Cited

FOREIGN PATENT DOCUMENTS

| | | | |
|---|---|---|---|
| JP | 2013-090061 | A | 5/2013 |
| KR | 2011-0092638 | A | 8/2011 |
| KR | 2015-0049340 | A | 5/2015 |
| WO | 2008/027705 | A1 | 3/2008 |
| WO | 2008/055537 | A1 | 5/2008 |

* cited by examiner

ELECTRONIC APPARATUS

CROSS REFERENCE TO RELATED APPLICATION

This application claims priority to and the benefit of Japanese Patent Application No. 2016-060484 (filed on Mar. 24, 2016), the entire contents of which are incorporated herein by reference.

TECHNICAL FIELD

This disclosure relates to an electronic apparatus.

BACKGROUND

A wearable terminal which may be worn on a user's body for use has recently been popularly used. As the wearable terminal, for example, electronic apparatuses described in PLTs 1 to 3 are known.

CITATION LIST

Patent Literature

PLT 1: JP-A-2013-90061
PLT 2: JP-A-11-353444
PLT 3: JP-T-2013-513275

SUMMARY

A radio communication apparatus worn by a user needs to satisfy that SAR (Specific Absorption Rate) is at a standard value or less. However, since in electronic apparatuses described in the PLTs 1 to 3 an antenna of the radio communication apparatus for transmission and reception of a radio wave is to be positioned in proximity to the user's head, the SAR is likely to increase exceeding the standard value. Also, since the radio wave radiated by the antenna is absorbed by the user's head, antenna efficiency becomes degraded.

Therefore, it could be helpful to provide an electronic apparatus capable of reducing the SAR and, simultaneously, suppressing degradation of the antenna efficiency.

An electronic apparatus according to one embodiment of the disclosure is an electronic apparatus to be worn on the user's head for use, the electronic apparatus includes:

a first temple to be positioned on one side of the user's head when the electronic apparatus is worn on the user's head;

a second temple to be positioned on the other side of the user's head when the electronic apparatus is worn on the user's head;

a first antenna formed in the first temple;

a second antenna formed in the second temple; and a transceiver circuit for supplying power to the first antenna and the second antenna.

The electronic apparatus of the disclosure is capable of reducing SAR and, simultaneously, suppressing degradation of antenna efficiency.

DETAILED DESCRIPTION

Hereinafter, one embodiment will be described with reference to the drawings.

Configuration of Electronic Apparatus

Figure 1:
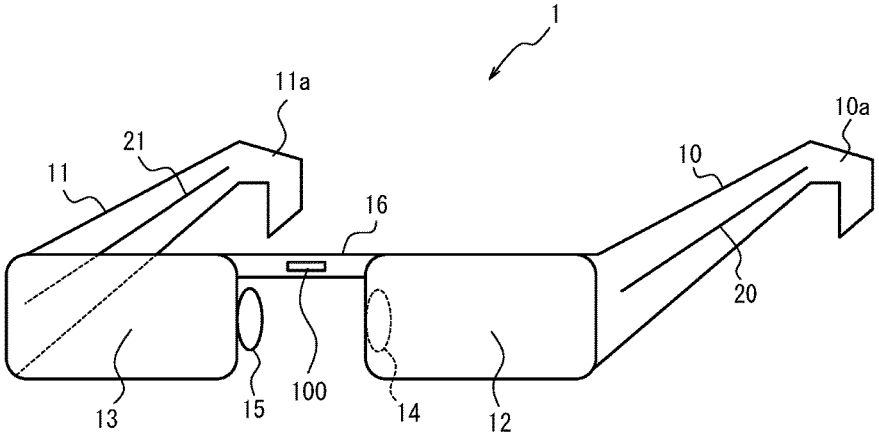
FIG. 1 is a perspective view illustrating an example of a configuration of an electronic apparatus according to one embodiment.

FIG. 1 is a perspective view illustrating an example of a configuration of an electronic apparatus 1 according to one embodiment. The electronic apparatus 1 includes temples 10 and 11, lenses 12 and 13, nose pads 14 and 15, a bridge 16, antennas 20 and 21, and a transceiver circuit 100. Note that FIG. 1 omits power supply lines and the like.

The temple (a first temple) 10, in a state where the electronic apparatus 1 is worn by a user (hereinafter, also referred to as a "user wearing state"), is positioned on a left side of the user's head. The temple (a second temple) 11, in the state where the electronic apparatus 1 is worn by the user, is positioned on a right side of the user's head.

The temple 10 includes a temple tip 10*a* at an end thereof. The temple 11 includes a temple tip 11*a* at an end thereof. The temple 10 also includes the antenna (a first antenna) 20. The temple 11 also includes the antenna (a second antenna) 21.

The temple tip 10*a* is hooked on the user's left ear in the user wearing state. The temple tip 11*a* is hooked on the user's right ear in the user wearing state.

The lens 12 has one end coupled to the temple 10 and the other end coupled to the bridge 16. The lens 13 has one end coupled to the temple 11 and the other end coupled to the bridge 16.

The lens 12 is positioned in front of the user's left eye in the user wearing state. The lens 13 is positioned in front of the user's right eye in the user wearing state.

The nose pad 14 is provided to a portion of the lens 12 in proximity to the bridge 16. The nose pad 15 is provided to a portion of the lens 13 in proximity to the bridge 16.

The nose pad 14 is placed on the left side of the use's nose in the user wearing state. The nose pad 15 is placed on the right side of the use's nose in the user wearing state.

The bridge 16 connects between the lens 12 on the left side and the lens 13 on the right side, thereby maintaining the lenses 12 and 13 in a predetermined positional relationship. The bridge 16 includes the transceiver circuit 100.

The antenna 20 is provided to the temple 10. The antenna 21 is provided to the temple 11. The antenna 20 and the antenna 21 are dipole antennas. Note that at least one of the antenna 20 and the antenna 21 may be an antenna of another type such as a monopole antenna. The antenna 20 and the antenna 21 transmit and receive radio waves. The antenna 20 and the antenna 21 receive power supplied from the transceiver circuit 100.

The transceiver circuit 100 supplies power to the antenna 20 and the antenna 21 at the time of transmission and receives the radio waves received by the antenna 20 and the antenna 21 at the time of reception. A total power supplied to the antenna 20 and the antenna 21 from the transceiver circuit 100 is also referred to as supplied power. The following is a detailed description of the transceiver circuit 100.

Figure 2:
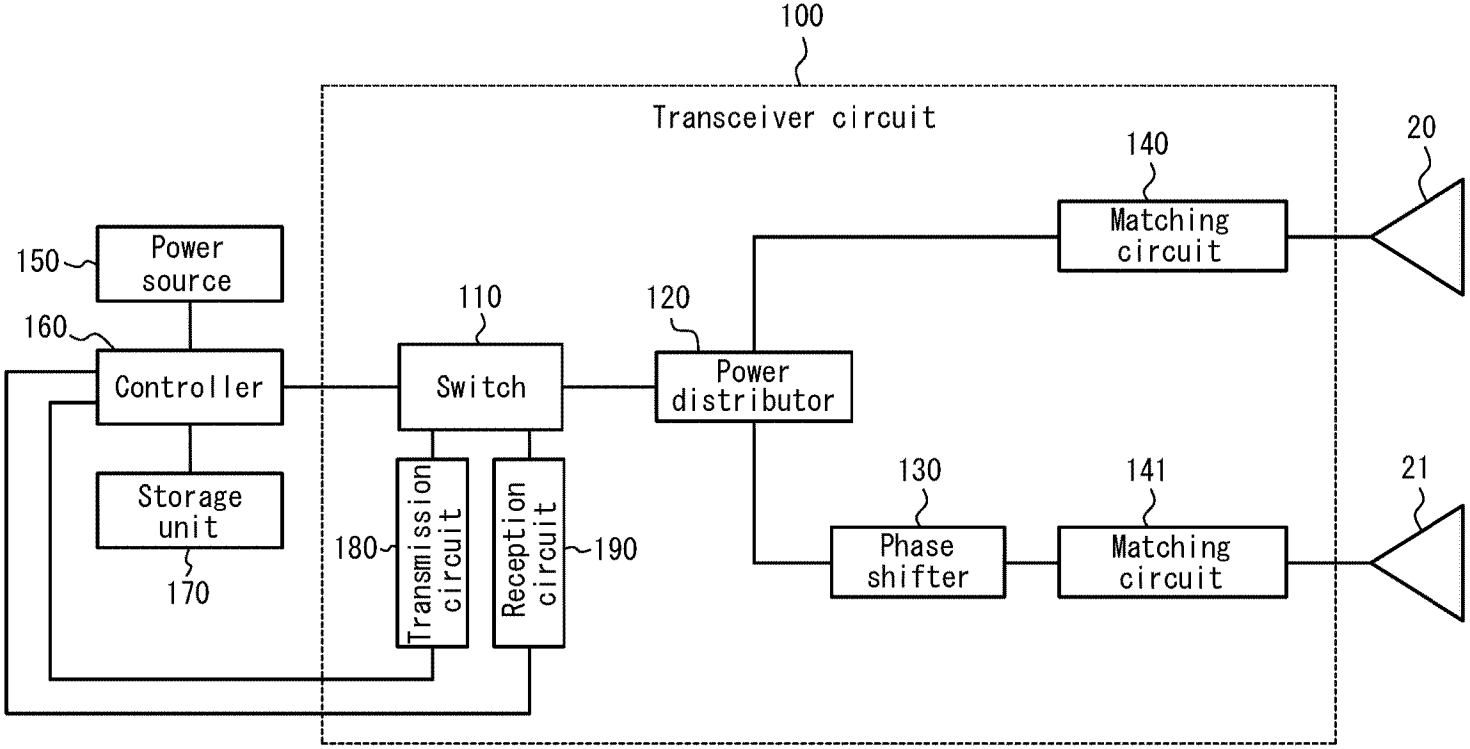
FIG. 2 is a functional block diagram illustrating a circuit configuration of the electronic apparatus illustrated in FIG. 1.

FIG. 2 is a functional block diagram illustrating a circuit configuration of the electronic apparatus 1 illustrated in FIG. 1. As illustrated in FIG. 2, the electronic apparatus 1 illustrated in FIG. 1 includes the transceiver circuit 100, a power source 150, a controller 160, and a storage unit 170.

The transceiver circuit 100 includes a switch 110, a power distributor 120, a phase shifter 130, matching circuits 140 and 141, a transmission circuit 180, and a reception circuit 190.

The transmission circuit 180 modulates a signal output from the controller 160 into a signal at a higher frequency and outputs a modulated signal to the switch 110.

The reception circuit 190 demodulates a signal output from the switch 110 into a signal at a lower frequency and outputs a demodulated signal to the controller 160.

The switch 110, according to control by the controller 160, connects between the power distributor 120 and the transmission circuit 180, or between the power distributor 120 and the reception circuit 190.

The power distributor 120 distributes a transmission signal supplied from the transmission circuit 180 via the switch 110 into two transmission signals at a predetermined ratio. The power distributor 120 supplies one of the transmission signals to the antenna 20 and the other to the antenna 21 via the phase shifter 130. The power distributor 120 is a T-junction distributor. However, other appropriate distributors including a Wilkinson distributor, a hybrid distributor, and a coupler may be used as the power distributor 120. In the present embodiment, the distributor distributes an input signal into two or more equal outputs or two or more unequal outputs.

The power distributor 120 outputs signals received from the antenna 20 and the antenna 21 to the reception circuit 190 via the switch 110.

The phase shifter 130 controls a phase of the transmission signal supplied from the power distributor 120. The phase shifter 130 supplies the transmission signal, whose phase is controlled, to the antenna 21. The phase shifter 130 may be implemented by, for example, adjusting a length of a wire between the switch 110 and the antenna 21. Or, in place of the phase shifter 130, for example, a 90-degrees hybrid power distributor or a 180-degrees hybrid power distributor may be used as the power distributor 130 to control the phase of the transmission signal. In this case, the transceiver circuit 100 may omit the phase shifter 130.

The matching circuit 140, by transforming impedance, matches impedance of the antenna 20 to impedance of a circuit constituting the transceiver circuit 100. The matching circuit 140 is connected to the antenna 20.

The matching circuit 141, by transforming the impedance, matches impedance of the antenna 21 to the impedance of the circuit constituting the transceiver circuit 100. The matching circuit 141 is connected to the antenna 21.

When each impedance of the antenna 20 and the antenna 21 is matched to the impedance of the circuit constituting the transceiver circuit 100, reflection of the transmission wave from the transmission circuit 180 at the antennas 20 and 21 is reduced during transmission, and therefore intensity of the transmission wave radiated is increased. During reception, reflection of a received signal from the antennas 20 and 21 is reduced, and therefore intensity of the received signal in the reception circuit 190 is increased. Note that the impedance within the matching circuits 140 and 141 may be adjusted according to a control signal from the controller 160.

The power source 150 is configured with, for example, a rechargeable secondary battery. The power source 150 supplies power to the transceiver circuit 100, the controller 160, and the storage unit 170. Although FIG. 2 shows an example in which the power source 150 is connected to the controller 160 alone, the power source 150 actually supplies power to various elements of the electronic apparatus 1.

The controller 160 controls the electronic apparatus 1 in its entirety and may be configured with, for example, a processor. The controller 160 retrieves and executes a program stored in the storage unit 170, thereby realizing various functions. The controller 160 may include DSP (Digital signal Processor).

The controller 160 outputs the transmission signal to the transmission circuit 180. Also, the controller 160 receives the signal from the reception circuit 190. Further, the controller 160, when the impedance within the matching circuits 140 and 141 are adjustable, adjusts the impedance within the matching circuits 140 and 141 by outputting the control signals thereto, such that the matching circuits 140 and 141 match the impedance of the antennas 20 and 21, respectively, to the impedance of the circuit constituting the transceiver circuit 100.

The storage unit 170 stores information necessary for operations of the controller 160, a program describing processing for realizing each function of the controller 160, and other necessary information.

In this way, the electronic apparatus 1 transmits and receives the radio waves from the antenna 20 provided to the temple 10 and the antenna 21 provided to the temple 11. Having two antennas 20 and 21, the electronic apparatus 1 may handle communication schemes such as diversity and MIMO (Multi Input Multi Output).

Figure 3:
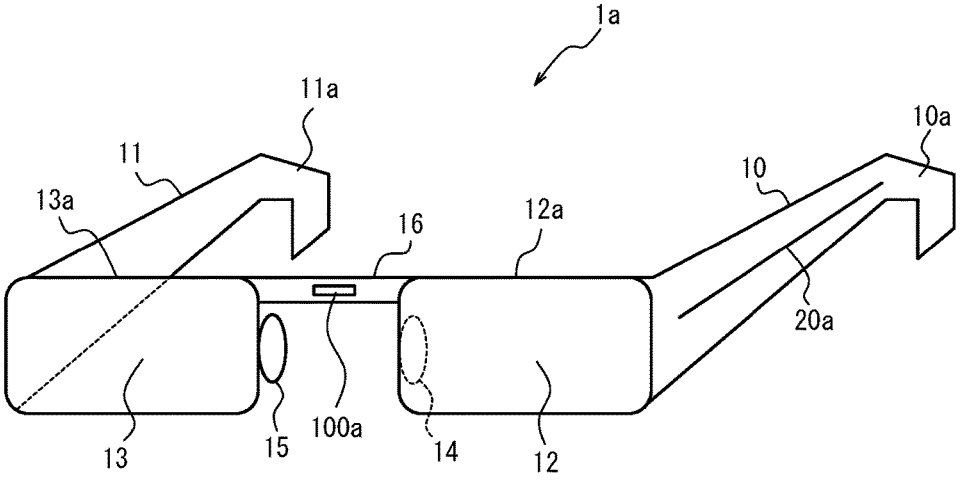
FIG. 3 is a diagram illustrating an example of a configuration of an electronic apparatus according to a comparative example.

The following is a description of an electronic apparatus 1*a* illustrated in FIG. 3 as a comparative example of the electronic apparatus 1 of one embodiment.

Comparative Example

FIG. 3 is a diagram illustrating an example of a configuration of the electronic apparatus 1*a* according to the comparative example. Note that elements illustrated in FIG. 3 identical to those illustrated in FIG. 1 are denoted by the same reference numerals, and descriptions thereof will be omitted. The electronic apparatus 1*a* includes the temples 10 and 11, the lenses 12 and 13, the nose pads 14 and 15, and the bridge 16. The bridge 16 includes a transceiver circuit 100*a*.

In the electronic apparatus 1*a* of the comparative example, as illustrated in FIG. 3, an antenna 20*a* is provided to the temple 10 alone. That is, the electronic apparatus 1*a* transmits the radio wave from the antenna 20*a* alone. The antenna 20*a* receives power supplied from the transceiver circuit 100*a*. The power supplied to the antenna 20*a* from the transceiver circuit 100*a* is also referred to as the supplied power.

Result of Comparison

Table 1 shows results of calculation of antenna efficiency and SAR using an electromagnetic field simulator under a condition in which the electronic apparatus 1 of one embodiment and the electronic apparatus 1*a* of the comparative example are worn by a person on the head. The antennas 20*a*, 20, and 21 are the dipole antennas for operating in a band of 900 MHz. For the electronic apparatus 1, also, the SAR is calculated by changing a ratio (a power distribution ratio) of the supplied power distributed into two branches which are respectively supplied to the antenna 20 and the antenna 21 from the transceiver circuit 100, and also by changing a phase difference between the distributed supplied power. When the power distribution ratio is 1:3 and 1:7, the phase shifter 130 is provided to either the antenna 20 or the antenna 21, whichever receives greater power. Note that the antenna efficiency refers to a ratio of the supplied power to a total radiated power from the antenna.

In a simulation, the electronic apparatus 1*a* of the comparative example has the antenna efficiency of −8.8 dB and the supplied power of 24 dBm in the band of 900 MHz. In Table 1, therefore, the SAR is calculated by adjusting the supplied power to the transceiver circuits 100 and 100*a* in such a manner that total radiated power (TRP, a sum of the supplied power [dBm] and the antenna efficiency [dB]) which affects the radiation of the radio wave in a far-field of the antenna becomes 15.2 (dBm), which is equal to the TRP of the comparative example

TABLE 1

Result of calculation of SAR with total radiated power of 15.2 [dBm]

| | Power Distribution Ratio [w] | Phase Difference [deg.] | Antenna Efficiency [dB] | SAR [W/kg] |
|---|---|---|---|---|
| Electronic Apparatus 1a (Comparative Example) | — | — | −8.8 | 3.09 |
| Electronic Apparatus 1 | 1:1 | 0 | −9.5 | 1.84 |
| | | 30 | −9.4 | 1.82 |
| | | 60 | −9.1 | 1.71 |
| | | 90 | −8.8 | 1.59 |
| | | 120 | −8.5 | 1.46 |
| | | 150 | −8.2 | 1.35 |
| | | 180 | −8.2 | 1.33 |
| | | 210 | −8.2 | 1.35 |
| | | 240 | −8.5 | 1.46 |
| | | 270 | −8.8 | 1.59 |
| | | 300 | −9.1 | 1.71 |
| | | 330 | −9.4 | 1.82 |
| | 1:3 | 0 | −9.4 | 2.68 |
| | | 30 | −9.3 | 2.60 |
| | | 60 | −9.1 | 2.46 |
| | | 90 | −8.8 | 2.28 |
| | | 120 | −8.5 | 2.13 |
| | | 150 | −8.3 | 2.04 |
| | | 180 | −8.2 | 2.01 |
| | | 210 | −8.3 | 2.07 |
| | | 240 | −8.5 | 2.18 |
| | | 270 | −8.8 | 2.35 |
| | | 300 | −9.1 | 2.53 |
| | | 330 | −9.3 | 2.64 |
| | 1:7 | 0 | −9.3 | 3.06 |
| | | 30 | −9.2 | 2.96 |
| | | 60 | −9.0 | 2.82 |
| | | 90 | −8.8 | 2.68 |
| | | 120 | −8.6 | 2.56 |
| | | 150 | −8.4 | 2.45 |
| | | 180 | −8.4 | 2.46 |
| | | 210 | −8.4 | 2.47 |
| | | 240 | −8.5 | 2.60 |
| | | 270 | −8.8 | 2.73 |
| | | 300 | −9.0 | 2.87 |
| | | 330 | −9.2 | 2.99 |

As shown in Table 1, values of the SAR of the electronic apparatus 1 with the phase difference of 0 [deg.] are 1.84 [W/Kg], 2.68 [W/Kg], and 3.06 [W/Kg] when the power distribution ratios are 1:1, 1:3, and 1:7, respectively. On the other hand, the value of the SAR of the electronic apparatus 1*a* is 3.09 [W/Kg]. That is, in the electronic apparatus 1, when the power distribution ratio is any one of 1:1, 1:3 and 1:7, the value of the SAR with the phase difference of 0 [deg.] is smaller than the value of the SAR of the electronic apparatus 1*a*. This is because the distribution of the power supply reduces the field intensity in proximity to the antennas 20 and 21 of the electronic apparatus 1 to be lower than the field intensity in proximity to the antenna 20*a* of the electronic apparatus 1*a*. This shows that simply distributing the supplied power into two branches, without generating the phase difference, and transmitting the radio waves from the antennas 20 and 21 may reduce the SAR to be smaller than the SAR of the electronic apparatus 1*a* which transmits the radio wave from one antenna 20*a* alone. In other words, the electronic apparatus 1 does not need to include the phase shifter 130 in the transceiver circuit 100 but may reduce the SAR simply by distributing the supplied power and transmitting the radio waves from the two antennas 20 and 21.

As shown in Table 1, also, the values of the SAR of the electronic apparatus 1 with the phase difference of 0 [deg.] are 1.84 [W/Kg], 2.68 [W/Kg], and 3.06 [W/Kg] when the power distribution ratios are 1:1, 1:3, and 1:7, respectively. This shows that, when no phase difference is generated between the power supplied to the antenna 20 and the power supplied to the antenna 21 (or when the phase shifter 130 is omitted), the power distribution ratio is preferably 1:1 (i.e, the power supplied to the antenna 20 and the power supplied to the antenna 21 are equal to each other).

As shown in Table 1, further, in a case where the electronic apparatus 1 has a fixed power distribution ratio, the value of the SAR becomes smaller when the phase difference is generated between the power supplied to the antenna 20 and the power supplied to the antenna 21 than the value of the SAR of when no phase difference is generated therebetween. This is because the phase difference between the supplied power causes generation of a phase difference between the radio waves transmitted from the antennas 20 and 21, and the radio waves having the phase difference interfere with each other and cancel each other out at the user's head. Therefore, it can be seen that, in the electronic apparatus 1, the SAR may be further reduced by distributing the supplied power and, also, by generating the phase difference between the supplied power.

Figure 4:
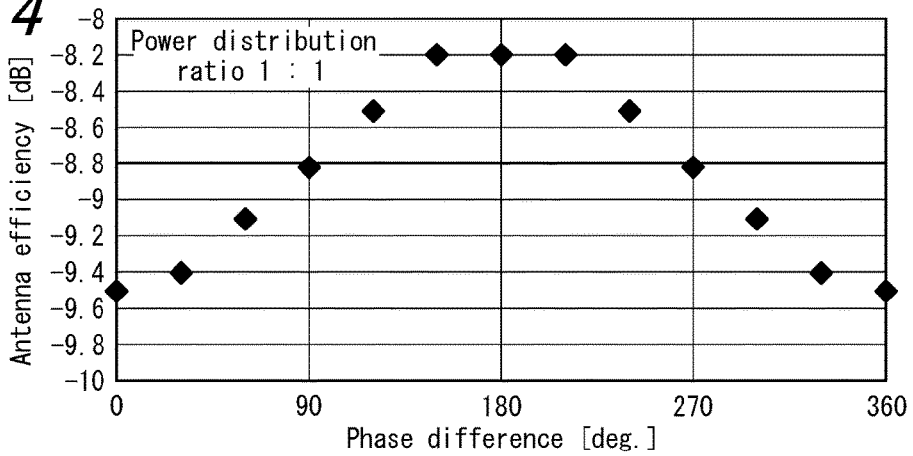
FIG. 4 is a graph illustrating phase difference dependency of antenna efficiency when a power distribution ratio of the electronic apparatus according to one embodiment is 1:1.
Figure 5:
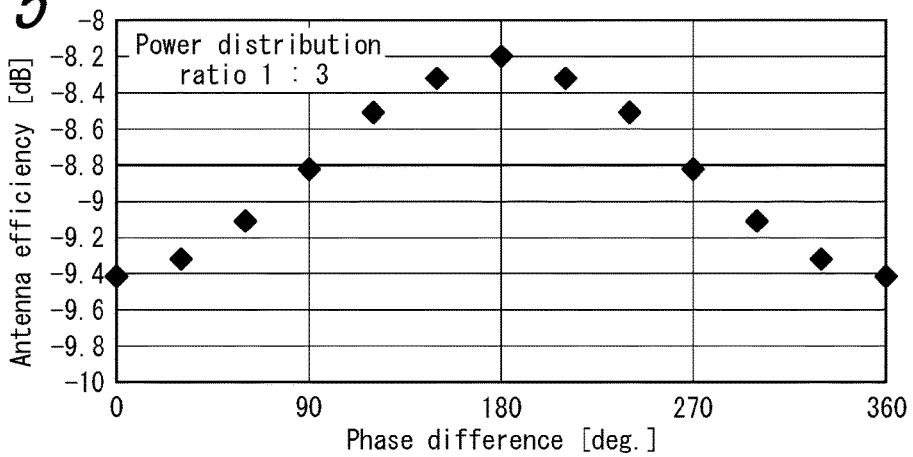
FIG. 5 is a graph illustrating the phase difference dependency of the antenna efficiency when the power distribution ratio of the electronic apparatus according to one embodiment is 1:3.
Figure 6:
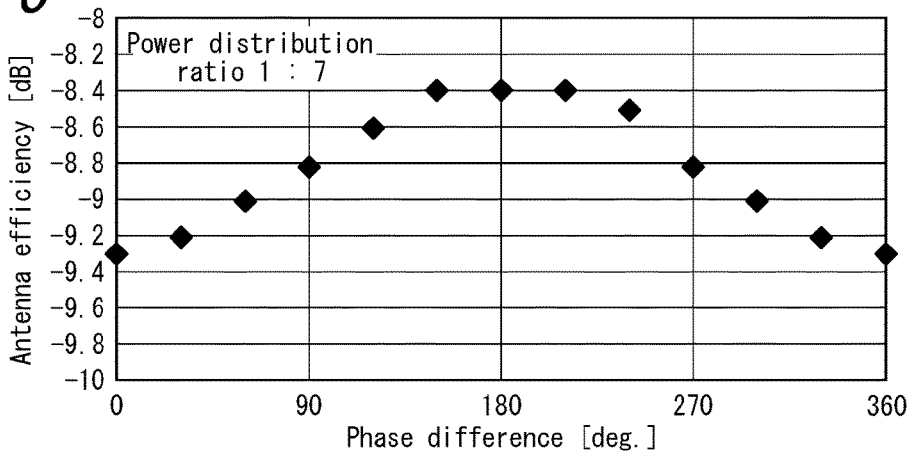
FIG. 6 is a graph illustrating the phase difference dependency of the antenna efficiency when the power distribution ratio of the electronic apparatus according to one embodiment is 1:7.

Next, for the antenna efficiency, a more preferable phase difference of the power supplied to the antennas 20 and 21 will be considered. FIG. 4 to FIG. 6 respectively illustrate graphs of phase difference dependency of the antenna efficiency when the power distribution ratios are 1:1, 1:3, and 1:7. In FIG. 4 to FIG. 6, a horizontal axis represents the phase difference [deg.], and a vertical axis represents the antenna efficiency [dB]. In FIG. 4 to FIG. 6, also, a bold line at the antenna efficiency of −8.8 [dB] refers to a value of the antenna efficiency of the antenna 20*a* of the electronic apparatus 1*a* of the comparative example. As illustrated in FIG. 4 to FIG. 6, the electronic apparatus 1 has the antenna efficiency greater than −8.8 [dB] when the phase difference is within a range of 90° to 270°, i.e., the antenna efficiency better than that of the electronic apparatus 1*a*.

Although in the above example the antenna 20 and the antenna 21 of the electronic apparatus 1 are respectively provided to the temple 10 and the temple 11, the antennas 20 and 21 may be provided elsewhere than the temples 10 and 11. For example, the antenna 20 and the antenna 21 may be respectively provided to an outside of the lens 12 and an outside of the lens 13 (e.g., a rim surrounding the lens 12 and a rim surrounding the lens 13).

Also, although in the above example the transceiver circuit 100 of the electronic apparatus 1 is provided to the bridge 16, the transceiver circuit 100 may be provided to elsewhere. For example, the transceiver circuit 100 may be provided to the temple tips 10*a* and 11*a*, or to the other ends of the temples 10 and 11 opposite to the temple tips 10*a* and 11*a*.

Further, although in the above example the phase shifter 130 of the electronic apparatus 1 is controlled so as to generate the phase difference between the power supplied to the antenna 20 and the power supplied to the antenna 21, the phase shifter 130 may be controlled so as to change a radiation pattern of the radio waves of the antennas 20 and 21. In this case, a ferroelectric substance, a ferrite, a switch, or the like are used to make the phase shifter 130 variable.

As described above, in the electronic apparatus 1 of one embodiment, the antenna 20 and the antenna 21 are respectively arranged at the temple 10 and the temple 11 to be positioned on either side of the user's head. Since the electronic apparatus 1 distributes the supplied power into two branches for transmission of the radio waves from the antennas 20 and 21, the field intensity in proximity to the antennas 20 and 21 are reduced. Therefore, the SAR may be reduced.

In the electronic apparatus 1 of one embodiment, also, since the phase difference is generated between the power supplied to the antenna 20 and the power supplied to the antenna 21, the radio waves interfere with each other and cancel each other out at the user's head. Therefore, the SAR may be further reduced.

In the electronic apparatus 1 of one embodiment, further, since the phase difference between the power supplied to the antenna 20 and the power supplied to the antenna 21 is within the range of 90° to 270°, the antenna efficiency may be further enhanced.

Although the disclosure has been described based on the figures and the embodiment, it is to be understood that various modifications and changes may be implemented based on the disclosure by those who are ordinarily skilled in the art. Accordingly, such modifications and changes are included in the scope of the disclosure. For example, functions and the like included in each constituent and step may be rearranged without logical inconsistency, so as to combine a plurality of constituents or steps together or to separate them. It should also be understood that, although the apparatus has been mainly described above, a method or a program executed by a processor of the apparatus and a storage medium storing the program may also implement the disclosure and thus are included in the scope of the disclosure.

The invention claimed is:

1. An electronic apparatus to be worn on the user's head for use, the electronic apparatus comprising:

a first temple to be positioned on one side of the user's head when the electronic apparatus is worn on the user's head;

a second temple to be positioned on the other side of the user's head when the electronic apparatus is worn on the user's head;

a first antenna formed in the first temple;

a second antenna formed in the second temple; and a bridge connecting the first temple and the second temple, the bridge having a transceiver circuit comprising:

a power distributor;

a first matching circuit coupling the power distributor to the first antenna;

a second matching circuit and a phase shifter coupling the power distributor to the second antenna;

a transmission circuit configured to generate a transmission signal;

a reception circuit; and a switch configured to couple the transmission circuit to the power distributor in a first switching condition controlled by a controller so that the power distributor provides the transmission signal to the first antenna via the first matching circuit and the transmission signal to the second antenna via the second matching circuit and the phase shifter, and configured to couple the reception circuit to the power distributor in a second switching condition controlled by the controller so that the power distributor provides a first received signal received at the first antenna to the reception circuit and a second received signal received at the second antenna to the reception circuit;

wherein the phase shifter is configured to generate a phase difference between the transmission signal provided to the first antenna and the transmission signal provided to the second antenna.

2. The electronic apparatus according to claim 1, wherein power supplied from the transceiver circuit to the first antenna and power supplied from the transceiver circuit to the second antenna are equal to each other.

3. The electronic apparatus according to claim 1, wherein the phase difference is within a range of 90° to 270°.

* * * * *